US008054255B2

(12) United States Patent
Lee

(10) Patent No.: US 8,054,255 B2
(45) **Date of Patent: *Nov. 8, 2011**

(54) ORGANIC LIGHT EMITTING DISPLAY DEVICE AND DRIVING METHOD THEREOF

(75) Inventor: Wook Lee, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 797 days.

This patent is subject to a terminal disclaimer.

(21) Appl. No.: 11/861,109

(22) Filed: Sep. 25, 2007

(65) Prior Publication Data

US 2008/0186260 A1 Aug. 7, 2008

(30) Foreign Application Priority Data

Feb. 5, 2007 (KR) ..... 10-2007-0011788

(51) Int. Cl.
*G09G 3/30* (2006.01)

(52) U.S. Cl. ..... 345/77; 345/82; 345/76

(58) Field of Classification Search ..... 345/45–48, 345/76–77, 80, 82–84, 87, 204, 207–214, 345/692, 697

See application file for complete search history.

(56) References Cited

U.S. PATENT DOCUMENTS

| | | | | |
|---|---|---|---|---|
| 5,315,694 | A | 5/1994 | Kasano | |
| 5,754,150 | A * | 5/1998 | Matsui | 345/89 |
| 7,369,183 | B2 | 5/2008 | Oka et al. | |
| 7,656,383 | B2 * | 2/2010 | Hedrick | 345/102 |
| 7,679,602 | B2 * | 3/2010 | Owyeung et al. | 345/156 |
| 7,724,247 | B2 | 5/2010 | Yamazaki et al. | |
| 7,728,526 | B2 * | 6/2010 | Lee | 315/169.3 |
| 7,746,317 | B2 | 6/2010 | Fu et al. | |
| 7,782,279 | B2 * | 8/2010 | Lee et al. | 345/82 |
| 7,839,091 | B2 | 11/2010 | Kohashikawa et al. | |
| 2002/0011978 | A1 | 1/2002 | Yamazaki et al. | |
| 2004/0041928 | A1 | 3/2004 | Hirakoso et al. | |
| 2005/0057191 | A1 * | 3/2005 | Jo et al. | 315/291 |
| 2005/0253835 | A1 | 11/2005 | Kawase | |

(Continued)

FOREIGN PATENT DOCUMENTS

JP 2000-221944 8/2000

(Continued)

OTHER PUBLICATIONS

Korean Patent Abstracts, Publication No. 1020060078590 A, Published on Jul. 5, 2006, in the name of Kwon.

(Continued)

*Primary Examiner* — Alexander S Beck
*Assistant Examiner* — Mansour M Said
(74) *Attorney, Agent, or Firm* — Christie, Parker & Hale, LLP

(57) ABSTRACT

An organic light emitting display device including: an optical sensor for generating an optical sensor signal corresponding to brightness of ambient light; a first luminance control unit for generating a pulse width (EW1) of a brightness control signal in accordance with the optical sensor signal; a second luminance control unit for generating a fluctuated value (EW2) for the pulse width of the brightness control signal in accordance with the optical sensor signal and data of one frame of the image; and a luminance control signal generation unit for generating a luminance control signal (Vc) for controlling a scan driver in accordance with the pulse width of the brightness control signal and the fluctuated value.

16 Claims, 5 Drawing Sheets

U.S. PATENT DOCUMENTS

| | | | | |
|---|---|---|---|---|
| 2006/0001624 | A1 | 1/2006 | Lee | |
| 2006/0114205 | A1 | 6/2006 | Shen et al. | |
| 2006/0244387 | A1 | 11/2006 | Park et al. | |
| 2007/0146302 | A1 | 6/2007 | Liu et al. | |
| 2008/0186262 | A1 | 8/2008 | Lee | |
| 2008/0186263 | A1 | 8/2008 | Lee | |
| 2008/0186264 | A1 | 8/2008 | Lee | |
| 2008/0204438 | A1* | 8/2008 | Song et al. | 345/207 |
| 2008/0246699 | A1* | 10/2008 | Oh | 345/76 |
| 2009/0166510 | A1* | 7/2009 | Park et al. | 250/205 |

FOREIGN PATENT DOCUMENTS

| | | | |
|---|---|---|---|
| JP | 2001-134255 | | 5/2001 |
| JP | 2005-308857 | | 11/2005 |
| JP | 2007-025317 | | 2/2007 |
| KR | 1992-0004293 | B1 | 6/1992 |
| KR | 1999-0030441 | U | 7/1999 |
| KR | 10-2000-0033177 | | 6/2000 |
| KR | 10-2004-0015910 | | 10/2005 |
| KR | 10-2005-0099303 | | 10/2005 |
| KR | 10-2006-0010912 | | 2/2006 |
| KR | 10-2006-0012738 | | 2/2006 |
| KR | 10-2006-0035831 | | 4/2006 |
| KR | 10-2006-0078590 | | 7/2006 |
| KR | 10-2006-0079573 | | 7/2006 |
| KR | 10-0629587 | B1 | 9/2006 |
| KR | 10-2006-0112997 | A | 11/2006 |
| KR | 10-2006-0113009 | | 11/2006 |
| KR | 10-2006-0120643 | | 11/2006 |

OTHER PUBLICATIONS

Korean Patent Abstracts, Publication No. 1020060079573 A, Published on Jul. 6, 2006, in the name of Kwon.

Korean Patent Abstracts, Publication No. 10-2006-0112997, dated Nov. 2, 2006, in the name of Young Jong Park et al.

U.S. Office action dated Sep. 1, 2010, for related U.S. Appl. No. 11/861,107.

U.S. Office action dated Sep. 16, 2010, for related U.S. Appl. No. 11/861,128.

U.S. Office action dated Sep. 14, 2010, for related U.S. Appl. No. 11/861,112.

U.S. Office action dated Feb. 24, 2011, for cross-reference U.S. Appl. No. 11/861,128.

U.S. Office action dated Feb. 25, 2011, for cross-reference U.S. Appl. No. 11/861,112.

KIPO Office action dated Mar. 27, 2008, for Korean Patent application 10-2007-0018657, 7 pages.

Korean Patent Abstract for Korean Publication 10-1990-0003762, dated Mar. 27, 1990, corresponding to Korean Patent 1992-0004293 listed above.

U.S. Office action dated Mar. 18, 2011, for cross-reference U.S. Appl. No. 11/902,649, 16 pages.

* cited by examiner

430

| SD | EW1 (HSYNC) |
|---|---|
| 00 | 109 |
| 01 | 181 |
| 10 | 253 |
| 11 | 325 |

FIG. 6

640

| UPPER 5-BIT VALUE (CONTROL DATA) | LIGHT EMITTING RATE | EW2 (HSYNC) |
|---|---|---|
| 0 | 0% | 0 |
| 1 | 4% | 0 |
| 2 | 7% | 0 |
| 3 | 11% | 0 |
| 4 | 14% | 0 |
| 5 | 18% | 2 |
| 6 | 22% | 4 |
| 7 | 25% | 6 |
| 8 | 29% | 8 |
| 9 | 33% | 10 |
| 10 | 36% | 12 |
| 11 | 40% | 14 |
| 12 | 43% | 16 |
| 13 | 47% | 18 |
| 14 | 51% | 20 |
| 15 | 54% | 22 |
| 16 | 58% | 24 |
| 17 | 61% | 26 |
| 18 | 65% | 28 |
| 19 | 69% | 30 |
| 20 | 72% | 32 |
| 21 | 76% | 34 |
| 22 | 79% | 36 |
| 23 | 83% | 38 |
| 24 | 87% | 40 |
| 25 | 90% | 42 |
| 26 | 94% | 44 |
| 27 | 98% | 46 |
| 28 | – | – |
| 29 | – | – |
| 30 | – | – |
| 31 | – | – |

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2007-0011788, filed on Feb. 5, 2007, in the Korean Intellectual Property Office, the entire content of which is incorporated herein by reference.

BACKGROUND

1. Field of the Invention

The present invention relates to an organic light emitting display device and a driving method thereof.

2. Discussion of Related Art

In recent years, various flat panel displays, which have reduced weight and volume compared to cathode ray tubes, have been developed. In particular, organic light emitting diode display devices have attracted public attention, because the organic light emitting diode display devices have an excellent luminance and color purity since organic compounds are used as light emission material.

Such an organic light emitting display device is expected to be effectively used for portable display devices and the like, since it is thin and lightweight and driven at a low electric power.

However, conventional organic light emitting display devices emit light with a constant luminance regardless of surrounding brightness, and therefore their visibility is varied according to the surrounding brightness even if an image is displayed with the same grey levels. For example, an image, which is displayed when the surrounding brightness is high, has a reduced visibility, compared to an image displayed when the surrounding brightness is low.

Also, in conventional organic light emitting display devices, the amount of electric current that flows to a display area increases as the number of pixels that emit the light during one frame period increases. Further, if there are pixels among the light-emitting pixels, that display high gray levels, a larger amount of electric current flows to the display area, resulting in increased power consumption.

SUMMARY OF THE INVENTION

Aspects of embodiments of the present invention are directed an organic light emitting display device capable of controlling a luminance according to brightness of ambient light and data of one frame, reducing power consumption, and/or preventing an excessive reduction of luminance, and a driving method thereof.

An exemplary embodiment of the present invention provides an organic light emitting display device for displaying an image and having a plurality of scan lines, a plurality of light emission control lines and a plurality of data lines. The organic light emitting display includes: a display area including a plurality of pixels coupled to the scan lines, the light emission control lines and the data lines; a scan driver electrically coupled to the display area through the scan lines and the light emission control lines; a data driver electrically coupled to the display area through the data lines; an optical sensor for generating an optical sensor signal corresponding to brightness of ambient light; a first luminance control unit for generating a pulse width of a brightness control signal in accordance with the optical sensor signal; a second luminance control unit for generating a fluctuated value for the pulse width of the brightness control signal in accordance with the optical sensor signal and data of one frame of the image; and a luminance control signal generation unit for generating a luminance control signal for controlling the scan driver in accordance with the pulse width of the brightness control signal and the fluctuated value.

In one embodiment, the second luminance control unit is controlled to be turned on or off according to the optical sensor signal. The second luminance control unit may be turned off when the optical sensor signal has a lower value than a reference value, and may be turned on when the optical sensor signal has a higher value than the reference value.

In one embodiment, the scan driver generates a light emission control signal having a width corresponding to the luminance control signal, and supplies the generated light emission control signal to at least one of the light emission control lines. A light emission time of the pixels may be controlled in accordance with the width of the light emission control signal.

In one embodiment, the first luminance control unit includes: an analog/digital converter for converting the optical sensor signal, which is an analog signal, into a digital sensor signal; a first lookup table for storing information of the pulse width of the brightness control signal corresponding to the digital sensor signal; and a first controller for extracting the information of the pulse width of the brightness control signal corresponding to the digital sensor signal from the first lookup table, and for supplying the information of the pulse width to the luminance control signal generation unit. The pulse width of the brightness control signal may be set so that a luminance of the display area is reduced if the digital sensor signal is a digital sensor signal corresponding to a darkest brightness level of the ambient light.

In one embodiment, the second luminance control unit includes: a data sum-up unit for summing up the data of one frame to generate sum-up data and for generating, as control data, at least two bit values including most significant bits of the sum-up data; a second lookup table for storing information of the fluctuated value corresponding to the control data; and a second controller for extracting the information of the fluctuated value corresponding to the control data from the second lookup table and for supplying the extracted information of the fluctuated value to the luminance control signal generation unit. The fluctuated value may be set so that a luminance of the display area is decreased with an increase in value of the control data. The second luminance control unit may further include a switch unit for transmitting the data of one frame to the data sum-up unit or interrupting transmission of the data to the data sum-up unit according to the optical sensor signal.

In one embodiment, the luminance control signal generation unit processes an operation of the pulse width of the brightness control signal with the fluctuated value, and generates the luminance control signal in accordance with a result of the operation of the pulse width with the fluctuated value. The luminance control signal generation unit may add or subtract the pulse width of the brightness control signal with the fluctuated value, and may generate the luminance control signal having a pulse width information of the light emission control signal in accordance with the pulse width of the brightness control signal and the fluctuated value.

Another exemplary embodiment of the present invention provides a method for driving an organic light emitting display device having a display area comprising a plurality of pixels. The method includes: generating an optical sensor signal corresponding to brightness of ambient light; generating a pulse width of a brightness control signal in accordance with the optical sensor signal; generating a fluctuated value for the pulse width of the brightness control signal in accordance with the optical sensor signal and data of one frame of an image; and controlling a luminance of the display area using the pulse width of the brightness control signal and the fluctuated value.

In one embodiment, the optical sensor signal suppresses the fluctuated value from being generated when the optical sensor signal has a lower value than a reference value.

In one embodiment, the generating the pulse width of the brightness control signal includes: converting the optical sensor signal into a digital sensor signal; and extracting information of the pulse width of the brightness control signal corresponding to the digital sensor signal.

In one embodiment, the generating the fluctuated value includes: adding the data of one frame to generate sum-up data and generating, as control data, at least two bit values including the most significant bits of the sum-up data; and extracting information of the fluctuated value corresponding to the control data.

In one embodiment, the controlling the luminance of the display area includes: generating a luminance control signal corresponding to the pulse width of the brightness control signal and the fluctuated value; generating a light emission control signal having a pulse width corresponding to the luminance control signal; and controlling a light emission time of the pixels included in the display area to correspond to the light emission control signal. The luminance control signal may generated by adding or subtracting the pulse width of the brightness control signal with the fluctuated value.

Another exemplary embodiment of the present invention provides an organic light emitting display device for displaying an image and having a plurality of scan lines, a plurality of light emission control lines and a plurality of data lines. The organic light emitting display includes: a display area including a plurality of pixels coupled to the scan lines, the light emission control lines and the data lines; a scan driver electrically coupled to the display area through the scan lines and the light emission control lines; a data driver electrically coupled to the display area through the data lines; an optical sensor for generating an optical sensor signal corresponding to brightness of ambient light; a luminance control signal generation unit for generating a luminance control signal for controlling the scan driver in accordance with a pulse width of a brightness control signal and a fluctuated value; a first luminance control unit for providing the pulse width of the brightness control signal in accordance with the optical sensor signal; and a second luminance control unit for providing the fluctuated value for the pulse width of the brightness control signal in accordance with the optical sensor signal and data of one frame of the image.

In one embodiment, the second luminance control unit is controlled to be turned on or off according to the optical sensor signal.

BRIEF DESCRIPTION OF THE DRAWINGS

These and/or other aspects and features of the invention will become apparent and more readily appreciated from the following description of the exemplary embodiments, taken in conjunction with the accompanying drawings of which:

FIG. 6 is an exemplary embodiment of a table illustrating values of a second lookup table shown in FIG. 5.

DESCRIPTION OF MAJOR PARTS IN THE FIGURES

Figure 1:
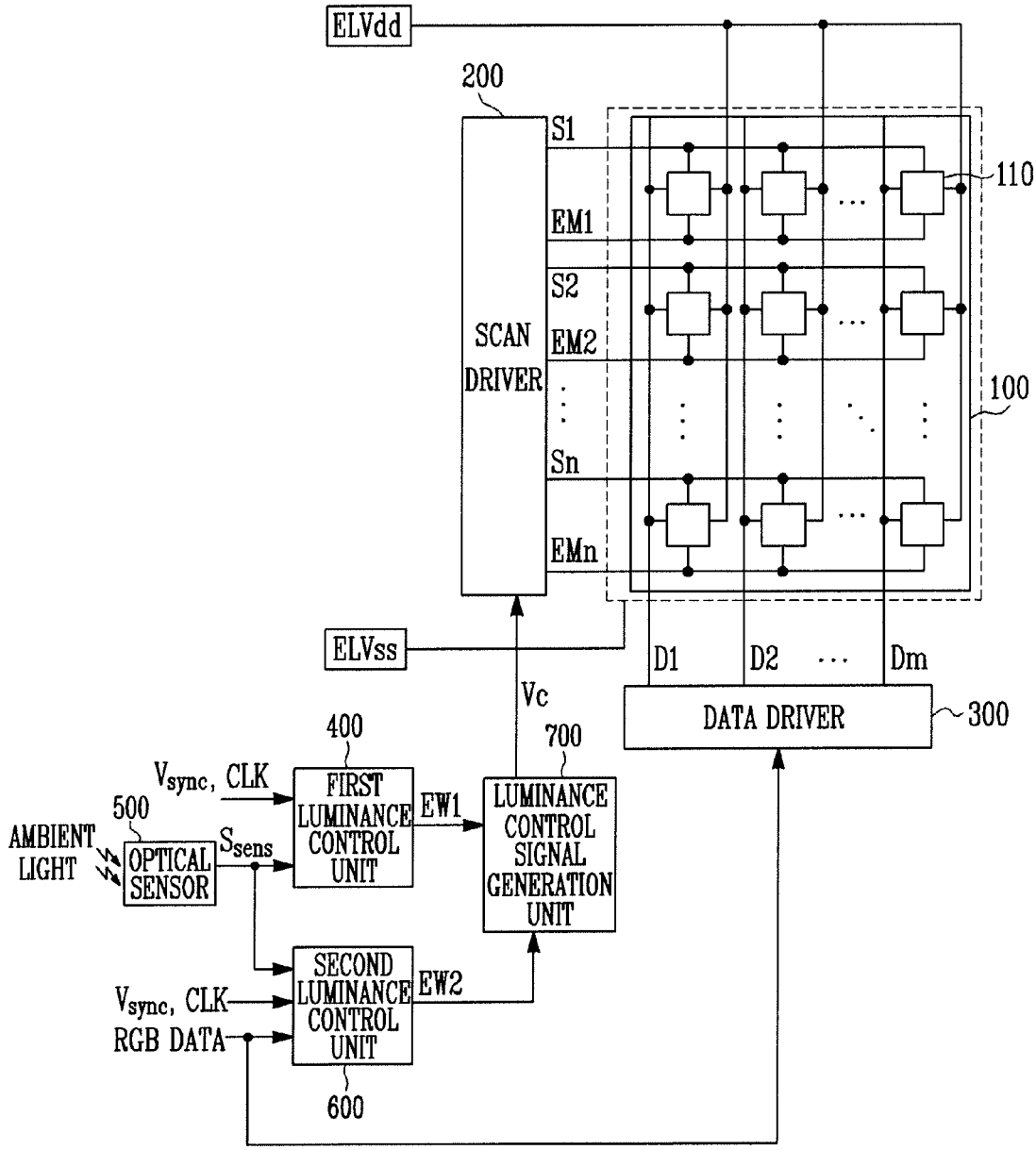
FIG. 1 is a block diagram showing a configuration of an organic light emitting display device according to one exemplary embodiment of the present invention.

| | |
|---|---|
| 100: display area | 200: scan driver |
| 300: data driver | 400: first luminance control unit |
| 500: optical sensor | 600: second luminance control unit |
| 700: luminance control signal generation unit | |

DETAILED DESCRIPTION OF EMBODIMENTS

Hereinafter, exemplary embodiments according to the present invention will be described with reference to the accompanying drawings. Here, when one element is referred to as being connected to another element, one element may be not only directly connected to the another element but instead may be indirectly connected to the another element via one or more other elements. Further, some of the elements that are not essential to the complete description of the invention have been omitted for clarity. Also, like reference numerals refer to like elements throughout.

Exemplary embodiments according to the present invention provide an organic light emitting display device capable of controlling luminance according to brightness of ambient light and data of one frame. The embodiments of the present invention may result in reduced power consumption.

If the brightness of the ambient light and the luminance corresponding to data of one frame are both employed to reduce or limit a luminance of a display area, then the luminance of the display area may be excessively reduced, resulting in deteriorated visibility. Therefore, in an exemplary embodiment according the present invention, when the brightness level of the ambient light is below a reference level (e.g., a predetermined or preset brightness level), the data of one frame is not used to further reduce or limit the luminance of the display area.

FIG. 1 is a block diagram showing a configuration of an organic light emitting display device according to one exemplary embodiment of the present invention.

Referring to FIG. 1, the organic light emitting display device according to one embodiment of the present invention includes a display area 100, a scan driver 200, a data driver 300, a first luminance control unit 400, an optical sensor 500, a second luminance control unit 600 and a luminance control signal generation unit 700.

The display area 100 includes a plurality of pixels 110 connected to scan lines (S1 to Sn), light emission control lines (EM1 to EMn) and data lines (D1 to Dm). Here, one pixel 110 has at least one organic light emitting diode and may be composed of at least two subpixels which emit lights having different colors, each subpixel having one organic light emitting diode having a corresponding color.

The display area 100 displays an image in accordance with a first power source (ELVdd) and a second power source (ELVss) supplied from the outside, a scan signal and a light emission control signal supplied from the scan driver 200; and a data signal supplied from the data driver 300.

The scan driver 200 is electrically connected with the display area 100 through the scan lines (S1 to Sn) and the light emission control lines (EM1 to EMn). The scan driver 200 generates the scan signal and the light emission control signal. The scan signal generated in the scan driver 200 is sequentially supplied to each of the scan lines (S1 to Sn), and the light emission control signal is sequentially supplied to each of the light emission control lines (EM1 to EMn).

Here, in one embodiment of the present invention, the scan driver 200 is set so that it can be controlled by using the luminance control signal generation unit 700. More particularly, in one embodiment, the scan driver 200 generates a light emission control signal having a width (or a pulse width) corresponding to a luminance control signal (Vc) supplied from the luminance control signal generation unit 700 and supplies the generated light emission control signal to the light emission control lines (EM). That is, the width (or the pulse width) of the light emission control signal generated in the scan driver 200 is controlled (or adjusted) by using the luminance control signal (Vc), and a light emission time of the pixels 110 is varied according to the changes in the pulse width of the light emission control signal, resulting in adjustment of the entire brightness of the display area 100.

The data driver 300 is electrically connected with the display area 100 through the data lines (D1 to Dm). The data driver 300 generates a data signal corresponding to image data (RGB Data) inputted thereinto during one frame period. The data signal generated in the data driver 300 is supplied to the data lines (D1 to Dm), and then supplied to each of the pixels 110 in synchronization with the scan signal.

The first luminance control unit 400 generates a pulse width (EW1) of the brightness control signal for controlling a pulse width of the light emission control signal in accordance with an optical sensor signal (Ssens) supplied from the optical sensor 500, and outputs the generated pulse width (EW1) of the brightness control signal into the luminance control signal generation unit 700.

More particularly, the first luminance control unit 400 selects a pulse width of the light emission control signal according to control signals supplied from the outside (such as the vertical synchronizing signal (Vsync) and the clock signal (CLK)), and the optical sensor signal (Ssens) supplied from the optical sensor 500; and outputs the pulse width (EW1) of the brightness control signal corresponding to the pulse width of the light emission control signal.

The first luminance control unit 400 outputs the pulse width (EW1) of the brightness control signal for controlling the display area 100 so that a luminance of the display area 100 can be decreased (that is, a light emission time of the pixels can be decreased) as the optical sensor signal corresponding to a relatively dark brightness level among the previously set levels of the brightness of the ambient light is supplied to the display area 100. For example, the first luminance control unit 400 outputs the pulse width (EW1) of the brightness control signal that maximally limits the light emission time of the pixels 110 when the optical sensor signal (Ssens) corresponding to the darkest brightness level among the previously set levels of the brightness of the ambient light is supplied to the display area 100.

The optical sensor 500 has an optical sensor element, such as a transistor or photodiode, to sense brightness of external light, namely the ambient light, and generates the optical sensor signal (Ssens) to correspond to the brightness of the ambient light. The optical sensor signal (Ssens) generated in the optical sensor 500 is supplied to the first luminance control unit 400 and the second luminance control unit 600.

The second luminance control unit 600 generates a fluctuated value (EW2) for a pulse width (EW1) of the brightness control signal in accordance with the optical sensor signal (Ssens) supplied from the optical sensor 500, and the data (RGB Data) of one frame, and outputs the generated fluctuated value (EW2) into the luminance control signal generation unit 700.

In one exemplary embodiment, the second luminance control unit 600 is controlled to be turned on or off in accordance with the optical sensor signal (Ssens). For example, the second luminance control unit 600 may be controlled to be turned off if the optical sensor signal (Ssens) having a value less than a reference value (e.g., a previously set value or a predetermined value) is supplied to the second luminance control unit 600, and controlled to be turned on if the optical sensor signal (Ssens) having a value greater than the reference value (e.g., the previously set value or the predetermined value) is supplied. In other words, it is determined whether or not an operation of the second luminance control unit 600 is carried out according to the optical sensor signal (Ssens), and therefore it is determined whether or not the fluctuated value is generated.

While this embodiment is described in detail, assuming that an analog optical sensor signal (Ssens) is supplied from the optical sensor 500 to the second luminance control unit 600, the present invention is not limited thereto. For example, in one embodiment, an analog/digital converter (not shown) is provided inside the optical sensor 500, and therefore it may convert an analog optical sensor signal (Ssens) into a digital signal, for example, a 1-bit digital signal having a value of '0' or '1' and provide the 1-bit digital signal to the second luminance control unit 600. In this case, the second luminance control unit 600 may be set so that it can be turned on/off in accordance with the digital signal supplied to the second luminance control unit 600.

If the optical sensor signal (Ssens) that turns on the second luminance control unit 600 is supplied, the second luminance control unit 600 selects the fluctuated value (EW2) for the pulse width (EW1) of the brightness control signal to correspond to the sum-up value of the data (RGB Data) supplied to the second luminance control unit 600 during one frame period, a synchronizing signal (Vsync), a clock signal (CLK) and the like. The fluctuated value (EW2) selected by (or in) the second luminance control unit 600 is supplied to the luminance control signal generation unit 700.

The luminance control signal generation unit 700 generates a luminance control signal (Vc) by using the pulse width (EW1) of the brightness control signal supplied from the first luminance control unit 400 and the fluctuated value (EW2) supplied from the second luminance control unit 600, and supplies the generated luminance control signal (Vc) to the scan driver 200 to control a pulse width of the light emission control signal generated in the scan driver 200.

In one embodiment, the luminance control signal generation unit 700 carries out (or processes) an operation of the pulse width (EW1) of the brightness control signal with the fluctuated value (EW2), and generates a luminance control signal (Vc) corresponding to a result of the operation of the pulse width with the fluctuated value.

For example, the luminance control signal generation unit 700 may add or subtract the pulse width (EW1) of the brightness control signal with the fluctuated value (EW2), and generate a luminance control signal (Vc) having a pulse width information of the light emission control signal corresponding to the resultant pulse width and fluctuated value. In one embodiment, if a luminance of the display area 100 is set so that it can be increased with the increase in the pulse width of the light emission control signal, then the luminance control signal generation unit 700 limits the luminance of the display area 100 by subtracting the pulse width (EW1) of the brightness control signal and the fluctuated value (EW2) to reduce a pulse width of the light emission control signal so that the luminance of the display area 100 is limited by using all of the two values. In another embodiment, if the case is reversed, that is, a luminance of the display area 100 is set so that it can be decreased with the increase in the pulse width of the light emission control signal, then the luminance control signal generation unit 700 limits the luminance of the display area 100 by adding the pulse width (EW1) of the brightness control signal with the fluctuated value (EW2) to increase a pulse width of the light emission control signal. Also, if the second luminance control unit 600 is turned off by the optical sensor 500, then the second luminance control unit 600 is controlled so that a light emission control signal corresponding to the pulse width (EW1) of the brightness control signal can be generated in the scan driver 200, by generating a luminance control signal (Vc) corresponding to the pulse width (EW1) of the brightness control signal set by the first luminance control unit 400.

According to the above-mentioned organic light emitting display device, the luminance of the display area 100 may be controlled in accordance with the brightness of the ambient light and the data of one frame.

More particularly, the problem that visibility is varied according to the surrounding brightness can be solved by controlling the luminance of the display area 100 to correspond to the brightness of the ambient light, and also a power consumption can be reduced by preventing the luminance of the display area 100 from being set to an excessively bright level when the ambient light is dark.

Also, when the brightness of the ambient light has a value greater than reference value (e.g., the predetermined value) and there are many more pixels displaying high gray levels during one frame period, an excessive electric current may be prevented from flowing to the display area 100 and a power consumption of the organic light emitting display device may be reduced, by controlling the luminance of the display area 100 corresponding to the data of one frame through limiting the pulse width of the light emission control signal to control an amount of electric current flowing to the display area 100.

Also, the excessive reduction of luminance may be prevented by setting the luminance of the display area 100 so that the optical sensor 500 can turn off the second luminance control unit 600 if the brightness of the ambient light has a lower value than the reference value (e.g., the predetermined value), for example, if the luminance of the display area 100 is maximally limited by the first luminance control unit 400. For example, in the darkest brightness level in the brightness of the ambient light, if the amount of electric current (namely, an amount of electric current according to the light emission time of the pixels 110) flowing to the display area 100 is maximally limited by using the pulse width (EW1) information of the brightness control signal generated in the first luminance control unit 400, then the excessive reduction in luminance may be prevented by turning off the second luminance control unit 600. In this case, it is possible to prevent unnecessary power consumption and the reduction to the safety margin for memory operation, caused by the operation of the second luminance control unit 600.

Figure 2:
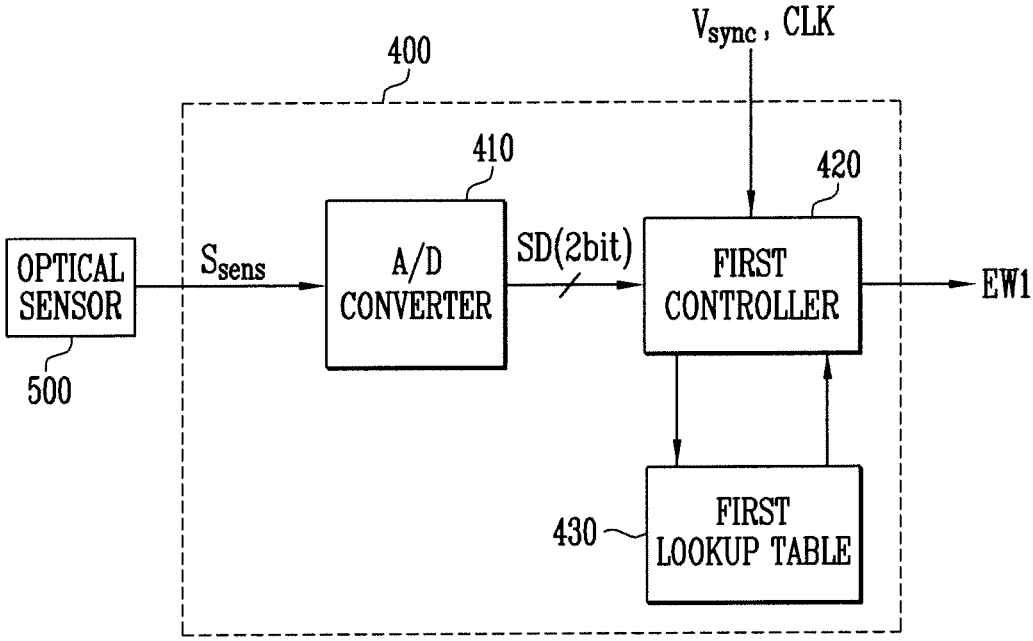
FIG. 2 is a block diagram showing one exemplary embodiment of a first luminance control unit as shown in FIG. 1.

FIG. 2 is a block diagram showing one embodiment of the first luminance control unit 400 shown in FIG. 1.

Referring to FIG. 2, the first luminance control unit 400 in one embodiment includes an analog/digital converter 410, a first controller 420 and a first lookup table 430.

The analog/digital converter (hereinafter, referred to as an A/D converter) 410 compares an analog optical sensor signal (Ssens) outputted from the optical sensor 500 to a reference voltage (e.g., a predetermined reference voltage), converts the analog optical sensor signal (Ssens) into a digital sensor signal (SD) corresponding to the reference voltage, and then outputs the converted analog optical sensor signal (Ssens).

For example, in one embodiment, when the A/D converter 410 divides a surrounding brightness into four levels and outputs a 2-bit digital sensor signal (SD) according to the surrounding brightness, the A/D converter 410 may output a digital sensor signal (SD) of "11" in the brightest surrounding brightness level, and output a digital sensor signal (SD) of "10" in a relatively bright surrounding brightness level. Also, the A/D converter 410 may output a digital sensor signal (SD) of "01" in a relatively dark surrounding brightness level, and output a digital sensor signal (SD) of "00" in the darkest surrounding brightness level. The digital sensor signal (SD) outputted in the A/D converter 410 is inputted into the first controller 420.

The first lookup table 430 stores a pulse width (EW1) information of the brightness control signal corresponding to each of the digital sensor signals (SD). Here, the pulse width (EW1) of the brightness control signal is a data value having an information about a width of the light emission control signal for controlling a light emission time of the pixels 110. The pulse width (EW1) of the brightness control signal is set so that the luminance of the display area 100 can be reduced by decreasing the light emission time of the pixels 110 when the brightness of the ambient light gets darker, that is, if the brightness of the ambient light is converted into a digital sensor signal (SD) corresponding to a relatively dark brightness level.

The first controller 420 is driven by control signals, such as the synchronizing signal (Vsync) and the clock signal (CLK), supplied therein to extract the pulse width (EW1) information of the brightness control signal, corresponding to digital sensor signals (SD) supplied from the A/D converter 410, from the first lookup table 430. The pulse width (EW1) information of the brightness control signal extracted by the first controller 420 is supplied to the luminance control signal generation unit 700.

Figure 3:
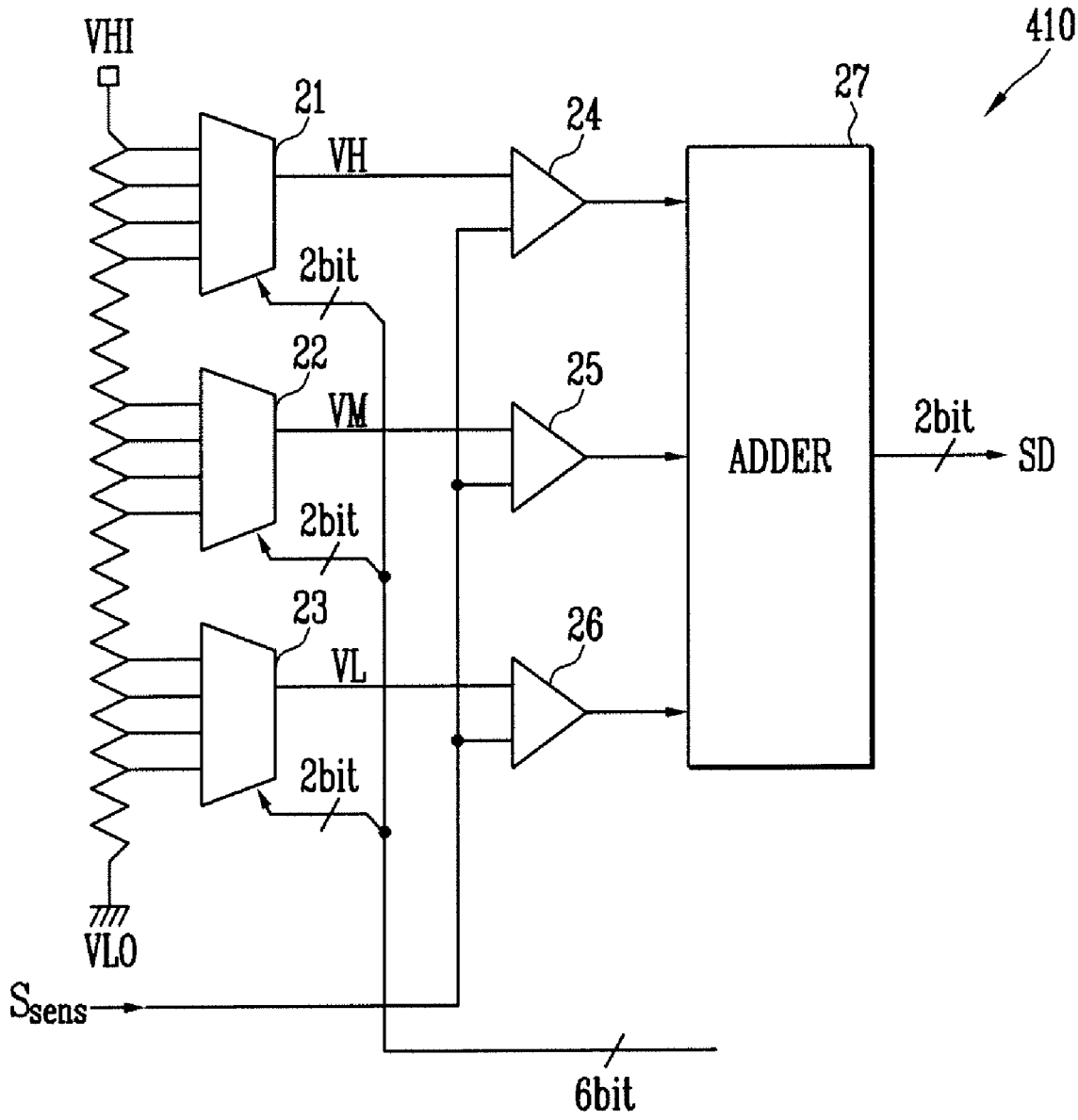
FIG. 3 is a block diagram showing one exemplary embodiment of an A/D converter shown in FIG. 2.

FIG. 3 is a diagram showing one exemplary embodiment of the A/D converter 410 shown in FIG. 2.

Referring to FIG. 3, the A/D converter 410 includes first, second and third selectors 21, 22, 23; first, second, and third comparators 24, 25, 26 and an adder 27.

The first to third selectors 21, 22, 23 receive a plurality of gray level voltages distributed through a plurality of resistance arrays for generating a plurality of gray level voltages (VHI to VHO), and outputs the gray level voltages corresponding to differently set 2-bit values, which is referred to as reference voltages (VH, VM and VL).

The first comparator 24 compares the analog optical sensor signal (Ssens) with a first reference voltage (VH) and outputs the resultant value. For example, the first comparator 24 may output "1" if an analog optical sensor signal (Ssens) is higher than a first reference voltage (VH), and "0" if an analog optical sensor signal (Ssens) is lower than a first reference voltage (VH).

In the same manner, the second comparator 25 outputs a value obtained by comparing the analog optical sensor signal (Ssens) with a second reference voltage (VM), and the third comparator 26 outputs a value obtained by comparing the analog optical sensor signal (Ssens) with a third reference voltage (VL).

Also, an area of the analog optical sensor signal (Ssens) corresponding to the same digital sensor signal (SD) may be changed by varying the first to third reference voltages (VH to VL).

The adder 27 adds up all of the resultant values outputted from the first to third comparators 24, 25, 26 and outputs the values as a 2-bit digital sensor signal (SD).

Hereinafter, an operation of the A/D converter 410 shown in FIG. 3 will be described in detail, assuming that the first reference voltage (VH) is set to 3V, the second reference voltage (VM) is set to 2V, the third reference voltage (VL) is set to 1V, and a voltage value of the analog optical sensor signal (Ssens) is increased as the ambient light becomes brighter.

If the analog optical sensor signal (Ssens) has a lower voltage than 1V, then all of the first to third comparators 24, 25, 26 output '0', and therefore the adder 27 outputs a digital sensor signal (SD) of '00'.

Also, if the analog optical sensor signal (Ssens) has a voltage between 1V and 2V, then the first to third comparators 24, 25, 26 output '0', '0', '1', respectively, and therefore the adder 27 outputs a digital sensor signal (SD) of '01'.

In the same manner, if the analog optical sensor signal (Ssens) has a voltage between 2V and 3V, then the adder 27 outputs a digital sensor signal (SD) of '10', and if the analog optical sensor signal (Ssens) has a higher voltage than 3V or more, then the adder 27 outputs a digital sensor signal (SD) of '11'.

The A/D converter 410 divides a brightness of the ambient light into four brightness levels while being driven in the above-mentioned manner, and then outputs '00' in the darkest brightness level, outputs '01' in a relatively dark brightness level, outputs '10' in a relatively bright brightness level, and outputs '11' in the brightest brightness level.

Figures 4, 5:
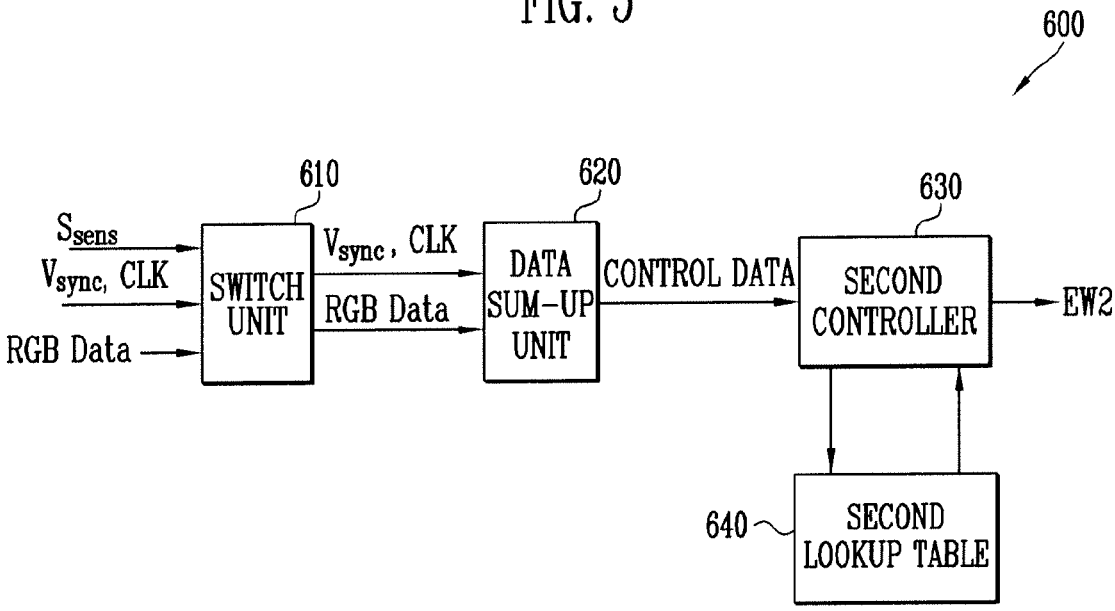
FIG. 4 is an exemplary embodiment of a table illustrating values of a first lookup table shown in FIG. 2.
FIG. 5 is a block diagram showing one exemplary embodiment of a second luminance control unit shown in FIG. 1.

FIG. 4 is a diagram showing one example of a first lookup table shown in FIG. 2. In one exemplary embodiment, the first lookup table as shown in FIG. 4 is based on an assumption that an amount of time that an electric current flows to the pixel 110 increases as the pulse width (EW1) of the brightness control signal becomes wider, and is provided for the purpose of illustrations only, and is not intended to limit the scope of the invention. That is, the content stored in the first lookup table may be varied by experiments, depending on the configuration of the pixel circuits, the resolution and size of the display area 100, etc.

Referring to FIG. 4, a pulse width (EW1) information of the brightness control signal corresponding to the digital sensor signal (SD) is stored in the first lookup table 430.

The pulse width (EW1) of the brightness control signal is set so that it can become narrower as the brightness of the ambient light becomes darker.

For example, the pulse width (EW1) of the brightness control signal, corresponding to the digital sensor signal (SD) of '00' outputted when the brightness of the ambient light is in the darkest brightness level, is set to the narrowest width, which corresponds to 109 cycles of a horizontal synchronizing signal (Hsync). As a result, a light emission time of the pixels 110 is reduced, resulting in reduction in the luminance of the display area 100 and the power consumption.

Also, the pixels 110 are controlled to emit the light for a sufficient amount of time by setting a pulse width (EW1) of the first light emission signal to an increasing pulse width with the increase in the brightness of the ambient light, and setting the pulse width (EW1) of the first light emission signal, corresponding to the digital sensor signal (SD) of '11' outputted when the brightness of the ambient light is in the brightest brightness level, which corresponds to 325 cycles of a horizontal synchronizing signal (Hsync). As a result, by controlling the luminance of the display area 100 according to the brightness of the ambient light, the reduction in the power consumption may be achieved and/or the deterioration of visibility of the display area 100 may be prevented.

FIG. 5 is a block diagram showing one exemplary embodiment of the second luminance control unit 600 shown in FIG. 1.

Referring to FIG. 5, the second luminance control unit 600 includes a switch unit 610, a data sum-up unit 620, a second controller 630 and a second lookup table 640.

The switch unit 610 transmits the control signals, such as a synchronizing signal (Vsync) and a clock signal (CLK), and data (RGB Data) of one frame to the data sum-up unit 620, or interrupts their transmission to the data sum-up unit 620 to correspond to the optical sensor signal (Ssens) supplied from the optical sensor 500.

For example, the switch unit 610 supplies the control signals such as the synchronizing signal (Vsync) and the clock signal (CLK), and the data (RGB Data) of one frame to the data sum-up unit 620 to correspond to the selection signal (Ssel) if the optical sensor signal (Ssens) having a value greater than a reference value (e.g., a predetermined value) that directs ON of the second luminance control unit 600 is inputted. Further, the switch unit 610 interrupts the supply of the control signals such as the synchronizing signal (Vsync) and the clock signal (CLK), and the data (RGB Data) of one frame to the data sum-up unit 620 in the other case, that is, if the optical sensor signal (Ssens) having a value greater than a reference value (e.g., a predetermined value) that directs OFF of the second luminance control unit 600 is inputted.

The data sum-up unit 620 generates sum-up data obtained by adding up image data (RGB Data) inputted during one frame period to correspond to the control signals, such as the synchronizing signal (Vsync) and the clock signal (CLK), and generates, as control data having at least two bit values including the uppermost bits (i.e., the most significant bits) of the sum-up data. Hereinafter, it is assumed that an upper (i.e., the most significant bits) 5-bit value of the sum-up data is set to the control data for convenience sake. Here, a high value of the sum-up data means that the data sum-up unit 620 includes a large amount of data having a high luminance more than a reference luminance (e.g., a predetermined luminance), and a low value of the sum-up data means that the data sum-up unit 620 includes a small amount of data having a high luminance more than the reference luminance (e.g., the predetermined luminance). The control data generated in the data sum-up unit 620 is transmitted to the second controller 630.

The second lookup table 640 stores a fluctuated value (EW2) information corresponding to the control data (for example, control data from 0 to 31 if the control data is set to a 5-bit value). Here, the fluctuated value (EW2) is a value obtained by carrying out an operation with the pulse width (EW1) of the brightness control signal by using the luminance control signal generation unit 700 to change the pulse width (EW1) of the brightness control signal, and the fluctuated value (EW2) is set so that the luminance of the display area 100 can be reduced with an increasing value of the control data. That is, the fluctuated value (EW2) is set to a higher value to limit the pulse width (EW1) of the brightness control signal to a wider extent as the value of the control data increases.

The second controller 630 extracts from the second lookup table 640 the fluctuated value (EW2) information, corresponding to the control data supplied from the data sum-up unit 620, and transmits the extracted fluctuated value (EW2) information to the luminance control signal generation unit 700.

FIG. 6 is a diagram showing one exemplary embodiment of a second lookup table 640 shown in FIG. 5. The second lookup table 640 shown in FIG. 6 is based on an assumption that the amount of time that an electric current flows to the pixel 110 for a shorter amount of time by reducing a pulse width (EW1) of the brightness control signal to be narrower in width as the fluctuated value (EW2) increases, but the description proposed herein is not intended to limit the scope of the invention. In practice, the content stored in the first lookup table may be varied, depending on the configuration of the pixel circuits, the resolution and size of the display area 100, etc.

Referring to FIG. 6, the fluctuated value (EW2) corresponding to an upper 5-bit value (namely, the control data) of the sum-up data is stored in the second lookup table 640. Here, the fluctuated value (EW2) is set so that it can be increased with an increasing value of the control data so as to limit a power consumption within a constant range (in other words, to limit the luminance). Here, if the control data has at least one value including the minimum value, then the fluctuated value (EW2) is sustained at a constant value.

By way of example, if the control data is set to a value of '4' or less, the fluctuated value (EW2) is set to a value of '0' in order not to limit the luminance any more. If the control data has at least one value including the minimum value, and the fluctuated value (EW2) is set to a value of '0' in order not to limit the pulse width (EW1) of the brightness control signal any more, then a contrast ratio may be improved when a dark image is displayed, and therefore an image having an improved contrast may be displayed.

If the control data is set to a value of '5' or more, then the fluctuated value (EW2) is slowly increased with an increasing value of the control data. As described above, if the control data has a higher value than at least one value including the minimum value, then the luminance is lowered since the pulse width (EW1) of the brightness control signal controlled by the first luminance control unit 400 is further limited as the fluctuated value (EW2) increases, and therefore the power consumption may be sustained within a constant range. Also, eye fatigue may be alleviated due to the limited luminance of the display area 100 even if one watches images for a long time. Actually, a ratio for limiting the luminance is increased since the increased number of pixels displaying high gray levels increases the value of the control data.

In order to prevent the excessive reduction of the luminance, the luminance is set to a maximally limited extent. For example, a fluctuated value (EW2) corresponding to the control data having a value of '27' or more may be set in the same manner (or substantially the same manner) as in a fluctuated value (EW2) corresponding to the control data having a value of '27'.

As described above, the organic light emitting display device according to exemplary embodiments of the present invention may be useful to control the luminance of the display area to correspond to the luminance of the ambient light and the data of one frame. In other words, the problem that visibility is varied according to the surrounding brightness can be solved by controlling the luminance of the display area to correspond to the brightness of the ambient light, and also a power consumption can be reduced by preventing the luminance of the display area from being set to an excessively bright level when the ambient light is dark. Also, an excessive electric current may be prevented from flowing to the display area and a power consumption may be reduced by controlling the luminance of the display area to correspond to the data of one frame if the brightness of the ambient light has a value greater than the reference value (e.g., the predetermined value), and limiting the pulse width of the light emission control signal to control an amount of electric current flowing to the display area if there are many pixels displaying high gray levels during one frame period.

Also, if the brightness of the ambient light has a lower value than the reference value (e.g., the predetermined value), for example, if the luminance of the display area is maximally limited by using the first luminance control unit, the excessive reduction in luminance may be prevented by turning off the second luminance control unit In this case, it is possible to prevent unnecessary power consumption and the reduction to the safety margin for memory operation, caused by the operation of the second luminance control unit 600.

The description provided herein is just exemplary embodiments for the purpose of illustrations only, and not intended to limit the scope of the invention, so it should be understood that other equivalents and modifications could be made thereto without departing from the spirit and scope of the invention as those skilled in the art would appreciate. Therefore, it should be understood that the present invention has a scope that is defined in the claims and their equivalents.

What is claimed is:

1. An organic light emitting display device for displaying an image and having a plurality of scan lines, a plurality of light emission control lines and a plurality of data lines, the organic light emitting display comprising:

a display area including a plurality of pixels coupled to the scan lines, the light emission control lines and the data lines;

a scan driver electrically coupled to the display area through the scan lines and the light emission control lines;

a data driver electrically coupled to the display area through the data lines;

an optical sensor for generating an optical sensor signal corresponding to brightness of ambient light;

a first luminance control unit for generating a pulse width of a brightness control signal in accordance with the optical sensor signal;

a second luminance control unit for generating a fluctuated value for the pulse width of the brightness control signal in accordance with the optical sensor signal and data of one frame of the image; and a luminance control signal generation unit for generating a luminance control signal for controlling the scan driver in accordance with the pulse width of the brightness control signal and the fluctuated value.

2. The organic light emitting display device according to claim 1, wherein the second luminance control unit is controlled to be turned on or off according to the optical sensor signal.

3. The organic light emitting display device according to claim 2, wherein the second luminance control unit is turned off when the optical sensor signal has a lower value than a reference value, and is turned on when the optical sensor signal has a higher value than the reference value.

4. The organic light emitting display device according to claim 1, wherein the scan driver generates a light emission control signal having a width corresponding to the luminance control signal, and supplies the generated light emission control signal to at least one of the light emission control lines.

5. The organic light emitting display device according to claim 4, wherein a light emission time of the pixels is controlled in accordance with the width of the light emission control signal.

6. The organic light emitting display device according to claim 1, wherein the first luminance control unit comprises:

an analog/digital converter for converting the optical sensor signal, which is an analog signal, into a digital sensor signal;

a first lookup table for storing information of the pulse width of the brightness control signal corresponding to the digital sensor signal; and a first controller for extracting the information of the pulse width of the brightness control signal corresponding to the digital sensor signal from the first lookup table, and for supplying the information of the pulse width to the luminance control signal generation unit.

7. The organic light emitting display device according to claim 6, wherein the pulse width of the brightness control signal is set so that a luminance of the display area is reduced if the digital sensor signal is a digital sensor signal corresponding to a darkest brightness level of the ambient light.

8. The organic light emitting display device according to claim 1, wherein the second luminance control unit comprises:

a data sum-up unit for summing up the data of one frame to generate sum-up data and for generating, as control data, at least two bit values including most significant bits of the sum-up data;

a second lookup table for storing information of the fluctuated value corresponding to the control data; and a second controller for extracting the information of the fluctuated value corresponding to the control data from the second lookup table and for supplying the extracted information of the fluctuated value to the luminance control signal generation unit.

9. The organic light emitting display device according to claim 8, wherein the fluctuated value is set so that a luminance of the display area is decreased with an increase in value of the control data.

10. The organic light emitting display device according to claim 8, wherein the second luminance control unit further comprises a switch unit for transmitting the data of one frame to the data sum-up unit or interrupting transmission of the data to the data sum-up unit according to the optical sensor signal.

11. The organic light emitting display device according to claim 1, wherein the luminance control signal generation unit processes an operation of the pulse width of the brightness control signal with the fluctuated value, and generates the luminance control signal in accordance with a result of the operation of the pulse width with the fluctuated value.

12. The organic light emitting display device according to claim 11, wherein the luminance control signal generation unit adds or subtracts the pulse width of the brightness control signal with the fluctuated value, and generates the luminance control signal having a pulse width information of a light emission control signal in accordance with the pulse width of the brightness control signal and the fluctuated value.

13. A method for driving an organic light emitting display device having a display area comprising a plurality of pixels, the method comprising:

generating an optical sensor signal corresponding to brightness of ambient light;

generating a pulse width of a brightness control signal in accordance with the optical sensor signal;

generating a fluctuated value for the pulse width of the brightness control signal in accordance with the optical sensor signal and data of one frame of an image; and controlling a luminance of the display area using the pulse width of the brightness control signal and the fluctuated value, wherein the generating the fluctuated value comprises:

adding the data of one frame to generate sum-up data and generating, as control data, at least two bit values including the most significant bits of the sum-up data; and extracting information of the fluctuated value corresponding to the control data.

14. A method for driving an organic light emitting display device having a display area comprising a plurality of pixels the method comprising:

generating an optical sensor signal corresponding to brightness of ambient light;

generating a pulse width of a brightness control signal in accordance with the optical sensor signal;

generating a fluctuated value for the pulse width of the brightness control signal in accordance with the optical sensor signal and data of one frame of an image; and controlling a luminance of the display area using the pulse width of the brightness control signal and the fluctuated value, wherein the controlling the luminance of the display area comprises:

generating a luminance control signal corresponding to the pulse width of the brightness control signal and the fluctuated value:

generating a light emission control signal having a pulse width corresponding to the luminance control signal; and controlling a light emission time of the pixels included in the display area to correspond to the light emission control signal, and wherein the luminance control signal is generated by adding or subtracting the pulse width of the brightness control signal with the fluctuated value.

15. An organic light emitting display device for displaying an image and having a plurality of scan lines, a plurality of light emission control lines and a plurality of data lines, the organic light emitting display comprising:

a display area including a plurality of pixels coupled to the scan lines, the light emission control lines and the data lines;

a scan driver electrically coupled to the display area through the scan lines and the light emission control lines;

a data driver electrically coupled to the display area through the data lines;

an optical sensor for generating an optical sensor signal corresponding to brightness of ambient light;

a luminance control signal generation unit for generating a luminance control signal for controlling the scan driver in accordance with a pulse width of a brightness control signal and a fluctuated value;

a first luminance control unit for providing the pulse width of the brightness control signal in accordance with the optical sensor signal; and a second luminance control unit for providing the fluctuated value for the pulse width of the brightness control signal in accordance with the optical sensor signal and data of one frame of the image.

16. The organic light emitting display device according to claim 15, wherein the second luminance control unit is controlled to be turned on or off according to the optical sensor signal.

* * * * *

UNITED STATES PATENT AND TRADEMARK OFFICE

CERTIFICATE OF CORRECTION

PATENT NO. : 8,054,255 B2
APPLICATION NO. : 11/861109
DATED : November 8, 2011
INVENTOR(S) : Wook Lee It is certified that error appears in the above-identified patent and that said Letters Patent is hereby corrected as shown below:

On the Title Page

| | |
|---|---|
| Item (56) References Cited, | Delete "10/2005" |
| page 2, left column, | Insert -- 2/2004 -- |
| Foreign Patent Documents, line 7 | |

In the Claims

| | |
|---|---|
| Column 14, Claim 14, line 9 | Delete "pixels" |
| | Insert -- pixels, -- |
| Column 14, Claim 14, line 25 | Delete "value:" |
| | Insert -- value; -- |

Signed and Sealed this
Tenth Day of September, 2013

Teresa Stanek Rea
*Acting Director of the United States Patent and Trademark Office*